United States Patent [19]

Reijnhard

[11] 4,052,022

[45] Oct. 4, 1977

[54] WINDING DEVICE

[75] Inventor: Johannes Martinus Reijnhard, Tilburg, Netherlands

[73] Assignee: U.S. Philips Corporation, New York, N.Y.

[21] Appl. No.: 679,803

[22] Filed: Apr. 23, 1976

[30] Foreign Application Priority Data

May 6, 1975 Netherlands ..... 7505279

[51] Int. Cl.[2] ..... B65H 59/10; B65H 77/00

[52] U.S. Cl. ..... 242/147 A; 226/118; 242/182

[58] Field of Search ..... 242/147 A, 45, 182, 242/183, 185, 75.3; 226/118

[56] References Cited

U.S. PATENT DOCUMENTS

| | | | |
|---|---|---|---|
| 2,796,223 | 6/1957 | Detweiler | 242/147 A UX |
| 2,862,675 | 12/1958 | MacDonald | 242/185 X |
| 3,091,408 | 5/1963 | Schoeneman | 242/182 |
| 3,180,547 | 4/1965 | Gruczelak et al. | 242/182 UX |
| 3,323,754 | 6/1967 | Nixdorf et al. | 242/147 A |
| 3,393,880 | 7/1968 | Keith et al. | 242/147 A X |
| 3,672,588 | 6/1972 | Bense | 242/147 A X |
| 3,908,920 | 9/1975 | Hermanns | 242/147 A X |

*Primary Examiner*—Stanley N. Gilreath
*Attorney, Agent, or Firm*—Frank R. Trifari; David R. Treacy

[57] ABSTRACT

A wire tension device for winding wire on an asymmetrical core or jig such that wire consumption periodically varies with the angle of rotation. Between the feed coil and the core a tensioning device is formed by two plates arranged parallel at some distance from each other, and are maintained at that distance by two side strips. The gap formed between the plates is closed on one side by a closing member comprising an inlet opening and an outlet opening for the wire and also an inlet for compressed air. One of the side strips is constructed to be gas-permeable.

5 Claims, 6 Drawing Figures

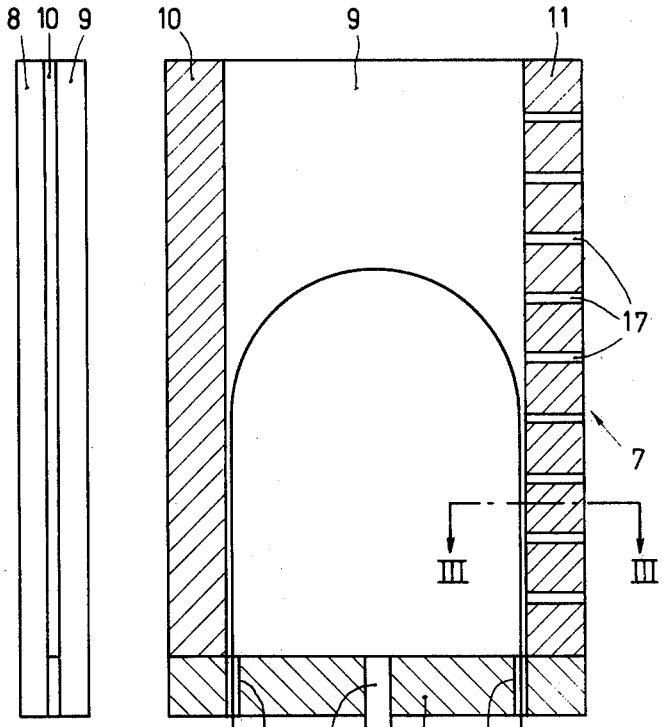
Fig. 2
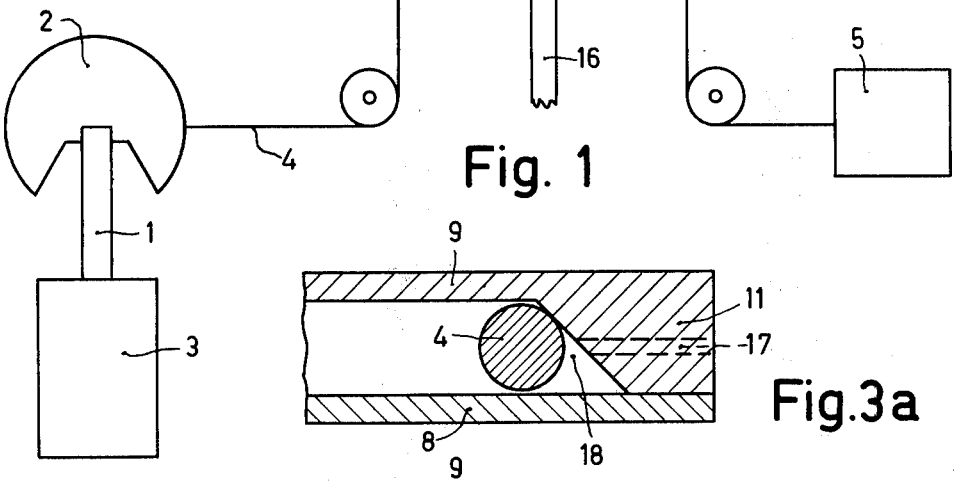
Fig. 1
Fig.3a
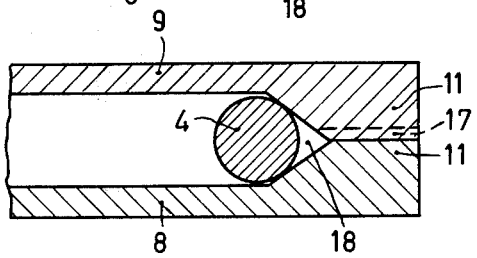
Fig.3b

WINDING DEVICE

BACKGROUND OF THE INVENTION

1. Field of the Invention

The invention relates to a winding apparatus in which the winding wire is fed from a feed spool to a core or jig to be provided with a winding, and in which a tensioning device is arranged between the feed spool and the core or jig, the apparatus further including means for braking a wire. The wire tensioning device is formed by two flat plates which are arranged at some distance from each other and which are maintained at that distance by two side strips on the sides of the plates, the gap formed between the plates being closed on one side by a closing member comprising an inlet opening and an outlet opening for the wire and also an inlet for compressed gas.

2. Description of the Prior Art

Winding apparatus of the kind described above are known from French Patent Specification No. 2,185,282.

Such apparatus can be used, for example, for depositing windings on rotors of electric motors having a rectangular or oval section. They can also be used for providing windings on toroidal cores of deflection coils for cathode ray tubes which also have an irregular section. Furthermore, using these machines saddle-shaped deflection coils can be wound on an irregular form.

Due to the asymmetrical shape of the core of the jig, the wire consumption during winding will vary as the angle of rotation varies; that is, the speed at which the wire is deposited on the core or the jig is subject to variation.

If the center of rotation of the winding jig or of the wire guide is situated outside the core to be provided with a winding, the winding wire must be periodically pulled back to avoid loose deposition of the wire.

As a result, variations in wire tension frequently occur, and these variations cause loose deposition or breakage of the wire at high winding speeds. Moreover, fluctuating wire tension causes irregular distribution of the turns, which is particularly undesirable in the case of deflection coils for television sets.

In order to reduce fluctuations in the wire tension, it is known to arrange a wire braking and tensioning device between the feed spool and the core or jig. Such a device should be able to take back a quantity of wire as quickly as possible during winding, so that the wire always remains taut; also, wire tension must be maintained as constant as possible, without any high tension peaks.

In a known device in accordance with the French Patent Specification No. 2,185,282 a supply of compressed air causes a pressure difference to arise across a length of the wire in a gap. This pressure differential exerts a constant force per unit length of wire, resulting in a given wire tension. Under the influence of the compressed air, the wire forms a loop which becomes smaller or larger as the wire accelerates or decelerates. The adaptation of the loop is very quick, because only the mass of the wire need be accelerated. However, the wire tension varies with the size of the loop.

In order to ensure that the wire loop in the tensioning device does not become too small or too large, this known device requires feedback to a separate wire braking device. Obviously, a separate wire brake of this kind makes the device expensive.

SUMMARY OF THE INVENTION

An object of the invention is to provide a combined wire tensioning and braking device.

A further object is to provide a device which produces very constant wire tension, regardless of the dimension of the loop, and hence independent of the acceleration or taking back of the wire.

This is achieved in accordance with the invention by constructing one of the side strips separating two parallel plates to be gas permeable, either by the provision of holes or by using a porous material. As a result, the portion of the wire loop contacting the side strip will be subject to a frictional braking force which is directly dependent on the length of the wire loop. The device also provides the advantage that variations in the friction coefficient between the wire and the strip do not affect the wire tension. In the case of uniform wire take-off, the position of the loop is a measure of the friction coefficient.

According to a further preferred embodiment of the invention the side of the side strip which faces the gap is shaped such that a wire cooperating therewith is situated in a wedge-like groove. This ensures proper contacting of the strip by the wire and prevents wire damage.

In order to enable wire of different diameters to be handled by this device without modifications being required, in a further embodiment yet of the invention a wheel on which the wire can be guided is situated in the gap between the two plates, the wheel having a width which is only slightly smaller than the width of the gap.

The invention will be described in detail hereinafter with reference to the drawing.

BRIEF DESCRIPTION OF THE DRAWING

FIG. 1 is a part diagrammatic, part sectional view of a winding apparatus embodying the invention.

FIG. 2 is a side view of the tension and braking device of FIG. 1.

FIGS. 3*a* and 3*b* are fragmentary cross-sectional views of two variations of the side strip shown in FIG. 1.

DESCRIPTION OF THE PREFERRED EMBODIMENTS

Figure 4:
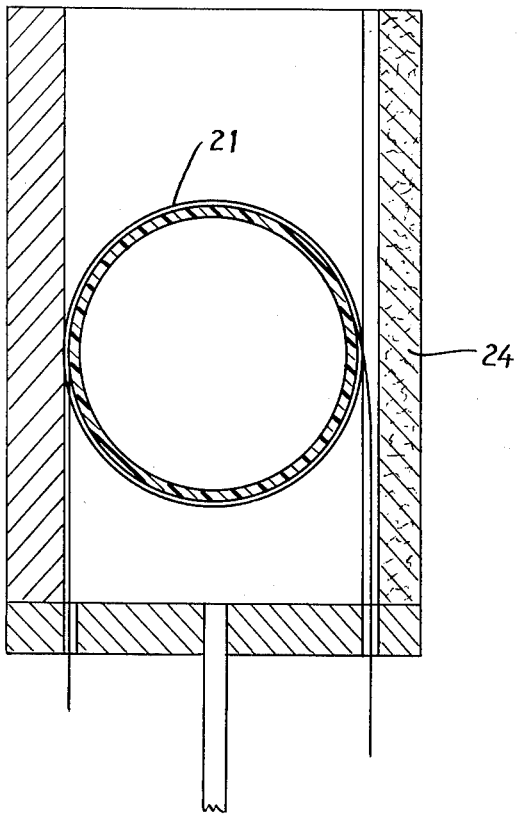
FIG. 4 is a sectional view of a tensioning embodiment usable with multiple wire sizes.
Figure 5:
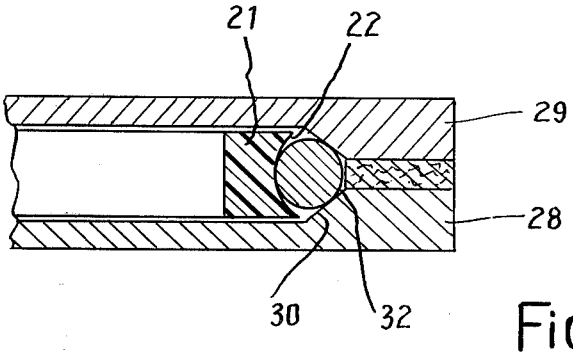
FIG. 5 is a cross-section of the embodiment of FIG. 4.

FIG. 1 diagrammatically shows a winding apparatus comprising a winding jig 2 arranged on a rotatable shaft 1 which is turned by a motor 3. Wire 4, supplied from a feed-spool 5, is applied to the jig 2.

The wire 4 passes through a wire tensioning device 7. This device includes two parallel plates 8 and 9 which are maintained at a fixed distance from each other by side strips 10 and 11, which may be separate strips, but which can also be formed by raised portions of the plates 8 and 9. The side strip 11 is provided with a number of through holes 17 spaced at intervals therealong, as also shown in FIG. 3*a* and 3*b.* The strip 11 can alternatively be made of a porous material. At one end a closing member 12 has openings 13 and 14 for wire inlet and outlet. The closing member furthermore has an opening 15 connected to a duct 16, the other end of the duct communicating with a source of compressed air (not shown).

The operation of this device is as follows. Upon rotation of the jig 2, wire 4 is wound thereon. Because the jig 2 has an asymmetrical (irregular) shape, the speed of the wire 4 will vary substantially, periodically with the angle of rotation of the shaft 1. This means that, if no steps are taken, the tension under which the wire is deposited on the jig will also be subject to substantial fluctuations and this, of course, is undesirable for forming a proper coil. In order to eliminate this phenomenon, the wire-tensioner 7 is included. The wire 4 passes with a given, very small clearance through the wire tensioner between the walls 8 and 9.

Compressed air is blown between the member 12 and the wire, through the tube 16 and the opening 15. Depending on the pressure of the compressed air, a given pressure difference arises across the wire.

The wire is pressed by the compressed air against the strip 11 at one side, and against the strip 10 on the other side. Because the strip 10 is constructed to be non-permeable, leakage around the wire will cause an air layer of substantially the same pressure between the wire and the strip 10, so that the wire is subject to hardly any friction at this area. Because the strip 11 is perforated with holes 17, however, the wire will be pressed against this strip by the pressure prevailing in the gap, so that it will be subjected to friction. The overall frictional force is then proportional to the air pressure, the friction coefficient between the wire and the surface, and the length of the wire which contacts the strip 11 and which varies with the dimension of the loop.

In order to ensure that the wire is not damaged by the holes 17 and to obtain proper separation between the space in the gap and the holes covered by the wire, the strip 11 is constructed so that the wire is situated in a wedge-shaped groove 18. FIGS. *3a* and *b* are sectional views of two feasible embodiments. The space 18 behind the wire will thus always be at a atmospheric pressure, and the wire will be pressed into the wedge-shaped groove by the pressure in the gap and against the flanks of the groove in a properly sealing manner.

A force is then exerted on the wire loop which corresponds to the pressure difference across the wire, multiplied by the projected surface area of the wire. This force, being constant during winding, should be so large that the wire is pulled off the spool 5 while sliding along the strip 11. The wire is taken off by the jig 2 at a fluctuating speed. If this speed decreases, initially the length of the wire loop increases. As a result, a longer piece of wire contacts the strip 11, so that the frictional force increases and the wire is pulled off the spool 5 at a decreased speed. The continued increasing of the wire loop is thus counteracted and a state of equilibrium is reached.

The reverse takes place when the speed at which the wire is taken up by the winding jig increases. Initially, the wire loop becomes smaller, so that a smaller length of wire contacts the strip 11, so that the frictional force decreases and the speed at which the wire is pulled off the spool 5 increases.

In this extremely simple manner it is possible to maintain the loop dimension in the tensioning device always substantially equal to a preselected mean value. In the case of uniform wire take-off, the loop dimension is a measure of the friction coefficient between the wire and the perforated strip.

FIG. 4 shows an embodiment which enables the wire tensioner to handle wire of different diameters without modifications being required. A wheel 21 is arranged in the gap between the plates, the wire being guided between the strips 10 and 11 and the edge of the wheel 21 and halfway around the edge of the wheel in a circumferential edge groove 22 of the wheel. Preferably, the width of the wheel is only slightly smaller than that of the gap, so that the wheel fits closely between the plates to minimize air flow past the wheel, and yet can move freely.

In order to keep the effects of inertia as small as possible, so that pay out and taking back of the wire will be completely responsive to the conformation of the winding jig, the wheel should have as small a cross-section and be made of as light a material as is possible consistent with rigidity. For example, a rim like a miniature bicycle wheel rim might be made of a hard aluminum alloy; molded plastics such as polypropylene are also advantageous because of the smooth surface which can be obtained, that will minimize damage to wire insulation.

Gas permeability of the one side strip may be provided either as holes, such as shown in FIG. 1, or by the use of a strip of porous material 24, such as felt or a sintered granular structure, held between plates 28 and 29. In a preferred embodiment the wheel 21 cooperates with a wedge-shaped groove 30 to position the wire so that a space 32 is formed between the wire and the porous material. Alternatively, an asymmetric structure such as that in FIG. *3a* can be used; further, there is no advantage to providing a groove in the porous material 24 if the minimum wire size is such that the wire would not contact the porous material; in such a case, the inner edge of the porous material may be left square for simplicity in manufacture.

What is claimed is:

1. A wire tension device for winding wire, comprising two plates having flat inner surfaces arranged parallel and at a fixed distance from each other, defining a gap therebetween; side strips between and connecting said plates; and an end closing member connected to said plates and said side strips, said member having an inlet opening and an outlet opening for passage of wire therethrough, and means for passing a flow of compressed gas through said closing member into said gap, wherein at least a portion of one of said strips is permeable to a flow of gas therethrough whereby wire passing through said device is subjected to friction against said one of said strips.

2. A device as claimed in claim 1, wherein said one of said strips has holes therethrough at intervals along said strip to permit flow of gas.

3. A device as claimed in claim 1, wherein said one of said strips comprises an elongated strip of porous material to permit gas flow therethrough.

4. A device as claimed in claim 1, wherein a side of said one of said strips facing the gap has an elongated wedge-shaped groove for positioning wire along the strip.

5. A device as claimed in clam 1, comprising in addition a wheel closely fitting for free movement between said plates in said gap, said wheel having a circumferential edge arranged to permit passing a bight of wire, extending within said gap between said inlet and outlet openings, between a first side strip and the wheel edge, partway around said circumferential edge, and between a second side strip and the wheel edge.

* * * * *